United States Patent [19]

Reehil

[11] Patent Number: 4,603,858

[45] Date of Patent: Aug. 5, 1986

[54] ABDOMINAL EXERCISER

[76] Inventor: Edward J. Reehil, 215 5th Ave., Bradley Beach, N.J. 07720

[21] Appl. No.: 668,413

[22] Filed: Nov. 5, 1984

[51] Int. Cl.[4] ..... A63B 23/02

[52] U.S. Cl. ..... 272/137; 272/143

[58] Field of Search ..... 272/116, 125, 126, 127, 272/135, 137, 140, 143, 93, 118, 117, 119, 121, 130, 132, 134; 128/25 R

[56] References Cited

U.S. PATENT DOCUMENTS

| | | | |
|---|---|---|---|
| 1,257,957 | 2/1918 | Kost | 272/127 X |
| 1,508,892 | 9/1924 | Mikalsen | 272/126 |
| 1,703,104 | 2/1929 | Hassler | 272/117 |
| 3,285,070 | 11/1966 | McDonough | 272/125 X |
| 4,108,429 | 8/1978 | Minichiello | 272/143 X |
| 4,363,481 | 12/1982 | Erickson | 272/125 |
| 4,387,893 | 6/1983 | Baldwin | 272/118 |
| 4,387,894 | 6/1983 | Baumann | 272/143 X |
| 4,407,496 | 10/1983 | Johnson | 272/143 X |

FOREIGN PATENT DOCUMENTS

| | | | |
|---|---|---|---|
| 457018 | 7/1913 | France | 272/134 |

OTHER PUBLICATIONS

The Swinger, Marcy Gym Equipment Company Catalog, ©1971, p. 32, Glendale, Calif. 91201.

*Primary Examiner*—Robert A. Hafer
*Assistant Examiner*—Arnold W. Kramer

[57] ABSTRACT

With the device belted around the waist and the user in either a standing or lying down position, the device is ready to be used. The leg restrainer #25 is, depending on the height of the individual, just above the knees. The stomach pad #3 is just below the waist and the chest pad #2 extends from the solar plexus up. The handles are a little below shoulder height and about shoulder width. When the device is being used resistence comes from the pressure between moving the leg restrainer and the chest pad and handles #6 and #7. When the opposite ends of the device are moved a large force is pushed inward at the joint wherein the stomach pad was placed. To keep the device locked so that it will not extend backwards past the vertical, the ends of tubes A and B meet in front of stomach pad #3 and behind the joint.

6 Claims, 2 Drawing Figures

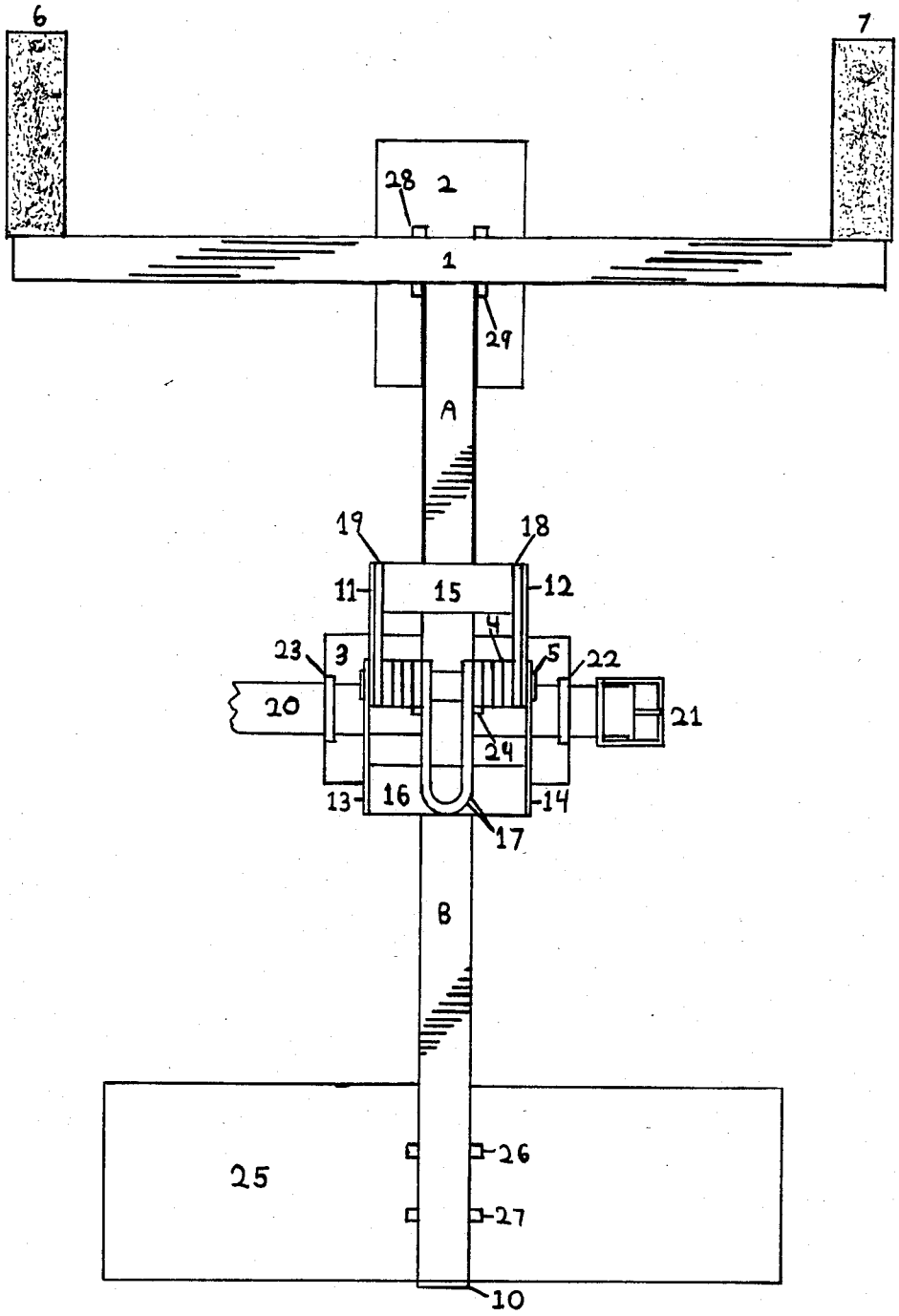
— Fig.1 —

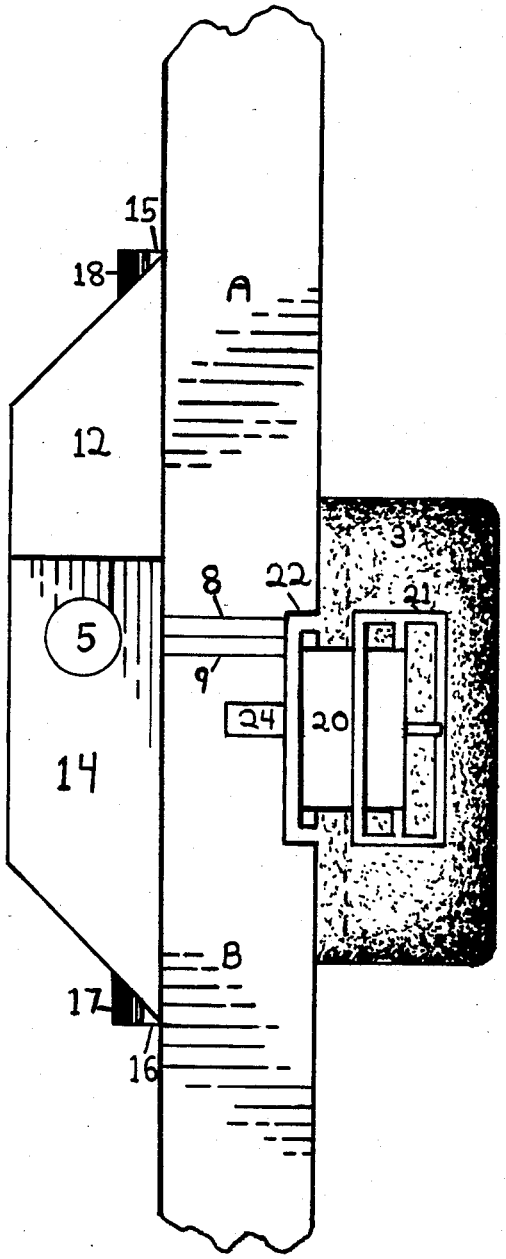
-Fig 2-

ABDOMINAL EXERCISER

SUMMARY

The idea of my invention was to create a light-weight and small device capable of providing enough resistence so that a healthy individual wouldn't have to waste an endless time doing situps or leglifts. I arrived at the idea by looking at a nautilus machine and thought a smaller device could be made fulfilling the same purpose simply by replacing the huge frame with a light jointed frame that worked like an elbow. A horizontally placed spring, two pieces of square hollow tubing, a belt, and various pads comprise the basics of my invention. The spring keeps the device loaded in the same plane and the resistance comes from moving the joint and connecting tubing. At the top of the frame are handles and a chestpad. In the middle there is a stomach pad and a belt which keeps the device in place when it's being used. A leg restrainer is at the bottom of the device and it does the same as it's title.

DESCRIPTION OF VIEWS

FIG. 1 is a front view of the device; and

FIG. 2 is a side view of the spring loaded pivot joint showing the abdominal pad and belt with buckle.

Sheet 1 of the 2 sheets is the front view done in a scale of 3:1. This view shows most of the important features except for the hidden features of the joint which are shown on sheet 2. Sheet 2 is done in a scale of 1:1 and is a cutaway of the side view of the joint. Only a few things on the device are hidden and those being the cross-sections of the fasteners and the insides of the plastic plugs.

DESCRIPTION

The center of the invention is the horizontally placed spring #4, placed between tube A and tube B. Tube A is 8 inches long and tube B is 12 inches long. The handles #6 and #7 are 4 inches in length and because of the crossbeam #1, they rise 5 inches above the top of tube A. All tubing is 1 inch square stock with a wall thickness of $\frac{1}{8}$ inch. The distance from the outside of one handle to the outside of the other is 18 inches making the inside distance 16 inches.

There are three plastic $\frac{1}{8}$ inch plugs #8, #9, and #10 extending past the ends of the tubing, 2 are at the joint, (8#,9#) and the other is at the bottom of tube B. Handles have hard foam coverings which extend $\frac{1}{4}$ inch over the top and $\frac{1}{8}$ inch past each side. This makes the width at it's widest point $18\frac{1}{4}$ inches and the overall length $25\frac{5}{8}$ inches. The spring #4 is held in place between tubes A and B by the joint, parts #5 and 11# through #16. The spring is 3/16 inch in diameter as concerns the metal and $3\frac{1}{8}$ inches concerning horizontal measurement.

It is wound six times on the left and the same on the right. The centerpiece #17 extends down to tube B and the two outer extensions #18 and #19 extend up to tube A. They are welded to parts #16 and #15 respectively. The joint is as follows: A pin #5, $3\frac{3}{4}$ inches long, extending through interior joint parts #11 and #12 and exterior joint parts #13 and #14. The pin is $\frac{1}{2}$ inch in diameter and the spring is wrapped around it at 1 inch in diameter. The dimensions of parts #11 through #14 are $\frac{1}{8}$ inch by 1 inch by 3 inches. The joint is connected at the top and bottom sections of the device by parts #15 and #16. They are welded to the tubes and to the insides of the joint parts and are perpendicular to parts #11 through #14 so as to sit flat on tubes A and B. Piece #17 lies ontop of #16 as does #18 and #19 lie ontop of #15. Parts #11 through #14 are cut at one end at a 45 degree angle. The dimensions of #15 are $\frac{1}{8}$ inch by 1 inch by $3\frac{1}{8}$ inches and for #16 are $\frac{1}{8}$ inch by 1 inch by $3\frac{3}{8}$ inches. A stomach pad #3 is situated on the backside of tube B. The pad extends 2 inches below the top of tube B, and both pads (which are identical except for the slots on the backing of #3) #2 and #3, should be made of hard but slightly flexible plastic and covered with foam and a tough plastic covering. The pads are 1 3/16 inches by 3 inches by 5 inches. The backing is 3/16 inches in width with pad #3 being situated length-wise (the 5 inch measurement going across) and the chest pad #2 being situated width-wise (the 3 inch measurement going across). A belt #20 passes behind plastic backing and pad #3, with a #21 buckle and belt-end equivalent to 2 inches on the user's left side and 35 inches of belt on the user's right side, with the 5 inches that pass behind the pad it makes the overall length 42 inches. The belt passes through 2 slots #22 and #23 in the backing and is held in place by a fastener #24 that passes through the belt and the backing and is welded to the sides of tube B thereby also holding the pad in place. The fasteners are shaped like large staples and are made of $\frac{1}{4}$ inch by $\frac{1}{4}$ inch by 3178 inches of steel. They are bent at 90 degrees with one inch left in the middle (1 inch inside measurement and $1\frac{1}{2}$ inches outside measurement) and 1 inch left to each side. The belt is 1 inch wide and 1/16 inch in thickness.

The slots are on the undercarriage of the pad (#3) and are $1\frac{1}{2}$ inches across and begin $\frac{3}{4}$ inch down either side putting them in the middle. The fastener is pushed through the belt in the middle and $1\frac{7}{8}$ inches over from either side. A plastic leg restrainer #25 is at the bottom of tube B and is $\frac{1}{4}$ inch by 4 inches by 14 inches. I is situated at the bottom and 4 inches upward. The restrainer is on the backside of tube B and over-hangs either side $6\frac{1}{2}$ inches. Two fasteners #26 and #27 are pushed through the leg restrainer and welded to tube B. The fasteners are located $1\frac{1}{4}$ inches from the top and bottom. A chest pad #2 is located on the backside of tube A of the same type and size as #3 only without the slots. The pad extends 3 inches over the top of tube A and 2 inches downward. It is held in place by two fasteners #28 and #29 placed $\frac{3}{4}$ inch in from each side of the pad on crossbeam #1 to which they are welded.

I claim:

1. An abdominal exercise device comprising two oppositely extending elongated structural member means; the opposing ends of said structural member means being pivotally joined to pivotal resistance means tending to pivot and hold said elongated structural member means in substantially the same plane; the free ends of said elongated structural member means each having a body contact member means attached thereto, with a third body contact member means attached to one of the elongated structural member means adjacent the pivotal resistance means and overlying the opposed ends with all said body contact member means lying in substantially the same plane; said third body contact member means having means for fastening said third body contact member means to the waist of an operator whereby, with the third body contact member means at the abdomen of the operator and the other two body contact member means at the chest and thighs respectively, the operator can do abdominal exercises, sit-ups, and leg lifts by pivoting the elongated structural member means against the opposition of the pivotal resistance means.

2. An abdominal exercise device as in claim 1 wherein said pivotal resistance means has the pivot axis offset from the same plane of said structural member means and on the opposite side of said plane than said third body contact member means.

3. An abdominal exercise device as in claim 1 wherein said resistance means is spring means.

4. An abdominal exercise device as in claim 1 wherein the top end of said elongated structural member having the chest contact member means has affixed thereto cross member means with hand grips.

5. An abdominal exercise device as in claim 4 wherein said elongated structural member means and said cross member means are formed of hollow tubing.

6. An abdominal exercise device as in claim 1 wherein said body contact member means are padded and said means for fastening is an adjustable belt means.

* * * * *